United States Patent [19]

Whitehouse et al.

[11] 4,257,285

[45] Mar. 24, 1981

[54] ROLLER DOOR OPERATING MECHANISM

[75] Inventors: Martin H. Whitehouse, Northmead; Mitchell J. Billows, East Hills, both of Australia

[73] Assignee: Byrne & Davidson Doors (N.S.W.) Pty. Limited, New South Wales, Australia

[21] Appl. No.: 11,677

[22] Filed: Feb. 12, 1979

[30] Foreign Application Priority Data

Feb. 15, 1978 [AU] Australia ..... PD3382
Mar. 16, 1978 [AU] Australia ..... PD3742

[51] Int. Cl.[3] ..... G05G 5/08

[52] U.S. Cl. ..... 74/405; 74/577 R; 248/652; 248/666

[58] Field of Search ..... 74/405, 242.1JR, 242.1 JB, 74/384, 575, 577 R; 248/652, 664, 666; 49/139

[56] References Cited

U.S. PATENT DOCUMENTS

| | | | |
|---|---|---|---|
| 1,616,027 | 2/1927 | Cheshire | 248/666 |
| 2,598,880 | 6/1952 | Beldin | 248/652 |

*Primary Examiner*—C. J. Husar
*Assistant Examiner*—Conrad Berman
*Attorney, Agent, or Firm*—Stevens, Davis, Miller & Mosher

[57] ABSTRACT

A roller shutter or door drum driving mechanism of the kind comprising a pivotally mounted electric motor, a gear train fixedly associated with said motor terminating in a pinion, a ring gear on the drum and manually operable, is furnished with releasable latch means which secure said motor and train in an operative position wherein the pinion meshes with the ring gear but, when released, permit the motor to move to an in-operative position wherein the pinion is clear of the ring gear.

5 Claims, 5 Drawing Figures

ROLLER DOOR OPERATING MECHANISM

This invention relates to electrically driven roller shutters or doors of the kind comprising a rotatable drum extending (in the case of a door) horizontally above the door-way, an electric motor gear connected to the drum for rotation thereof and a stiffly resilient or linked-slat curtain sheet which is wound onto or unwound from the drum as needed from time to time.

Conventionally, the gear train between the motor and the drum includes at least two reduction stages, with the final stage being a pinion in mesh with a ring gear on the drum.

The first stage or earlier stages (that is to say the gear connection between the motor and the pinion) provides a large speed reduction and thus it is difficult, if not impossible, to raise or lower the curtain sheet by hand in the event that the motor is inoperative due to a power or other failure. Indeed, in the majority of installations, the first stage reduction is a worm and wheel which is irreversible so rendering it impossible to move the sheet by hand.

Clearly, if a roller door provides the only egress from a room, a failure of the above kind might have quite serious consequences.

An object of the present invention is to overcome the above indicated disability in prior known doors or shutters.

The invention achieves that object by providing a pivotally mounted motor and gear box such that the motor and box may be swung to an inoperative position wherein the pinion is clear of the ring gear to permit free rotation of the latter.

Thus, the invention consists in a roller shutter or door drum driving mechanism comprising a pivotally mounted electric motor, a gear train fixedly associated with said motor terminating in a pinion, a ring gear on the drum and manually operable, releasable latch means which secure said motor and train in an operative position wherein the pinion meshes with the ring gear but, when released, permit the motor to move to an in-operative position wherein the pinion is clear of the ring gear.

By way of example, an embodiment of the invention is described hereinafter with reference to the accompanying drawings.

The illustrated embodiment of the invention comprises a mounting plate 3 adapted to be secured by a clamp 4 to a fixed axle 19 of a roller door.

Figure 3:
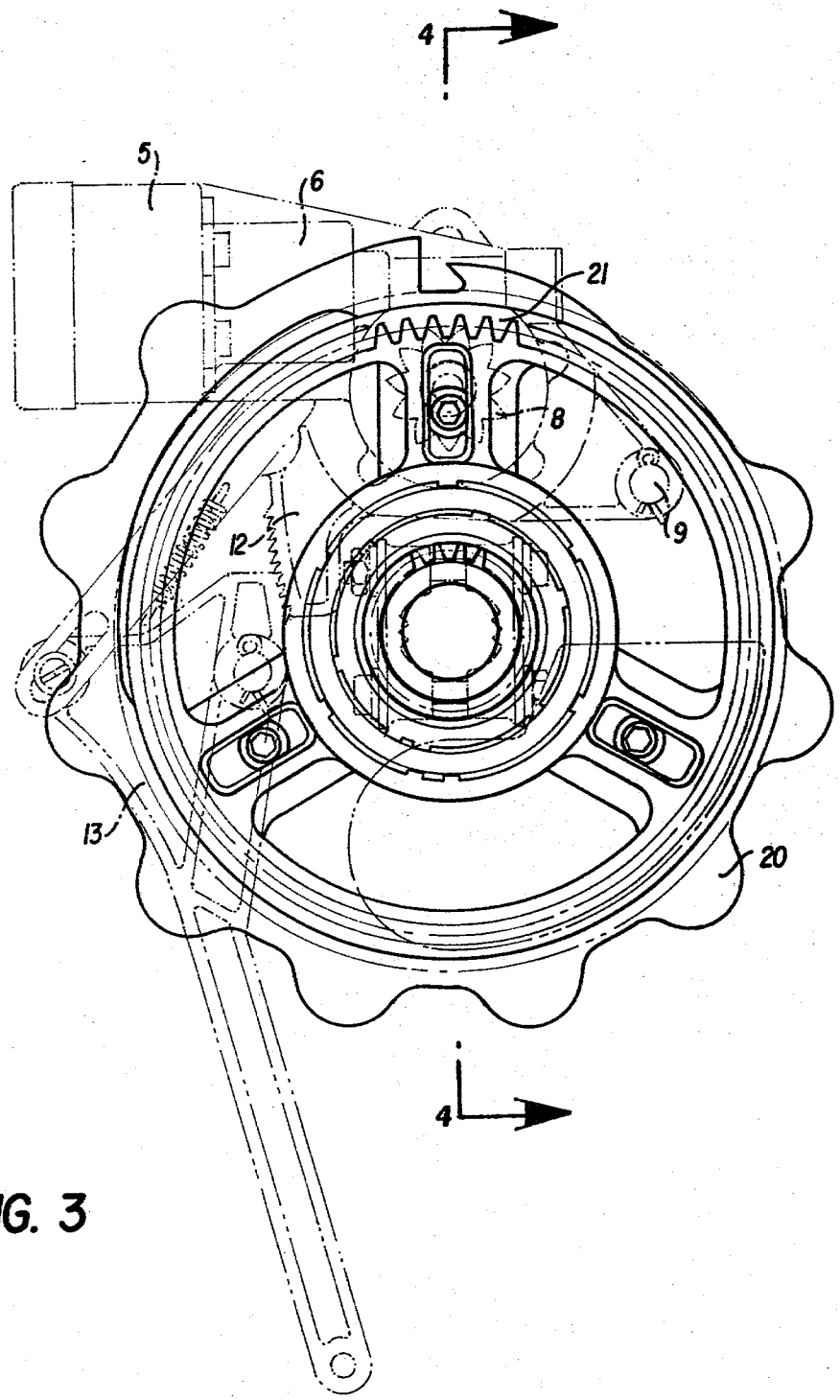
FIG. 3 is a view similar to FIG. 1 but with some of the parts shown in phantom outline to better view the interior of the mechanism.
Figure 4:
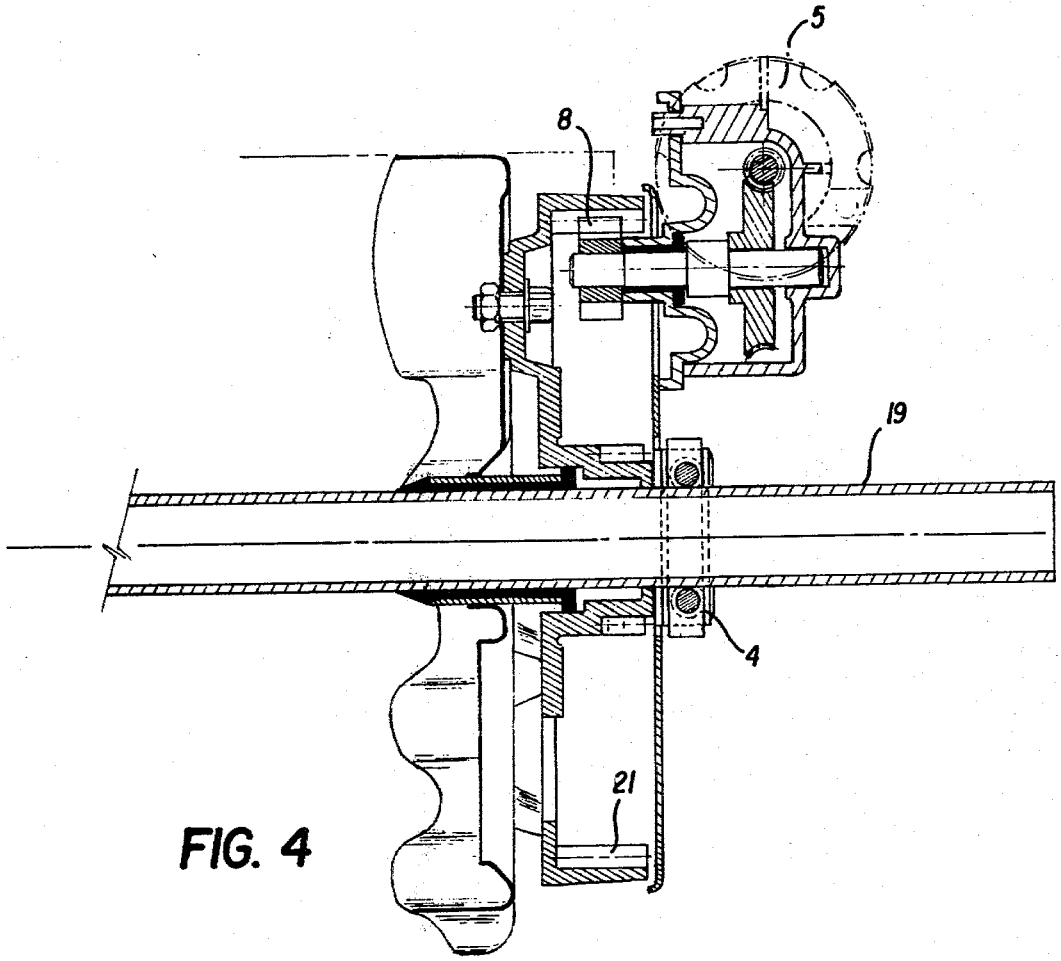
FIG. 4 is a sectional view taken along line 4—4 of FIG. 3.
Figure 5:
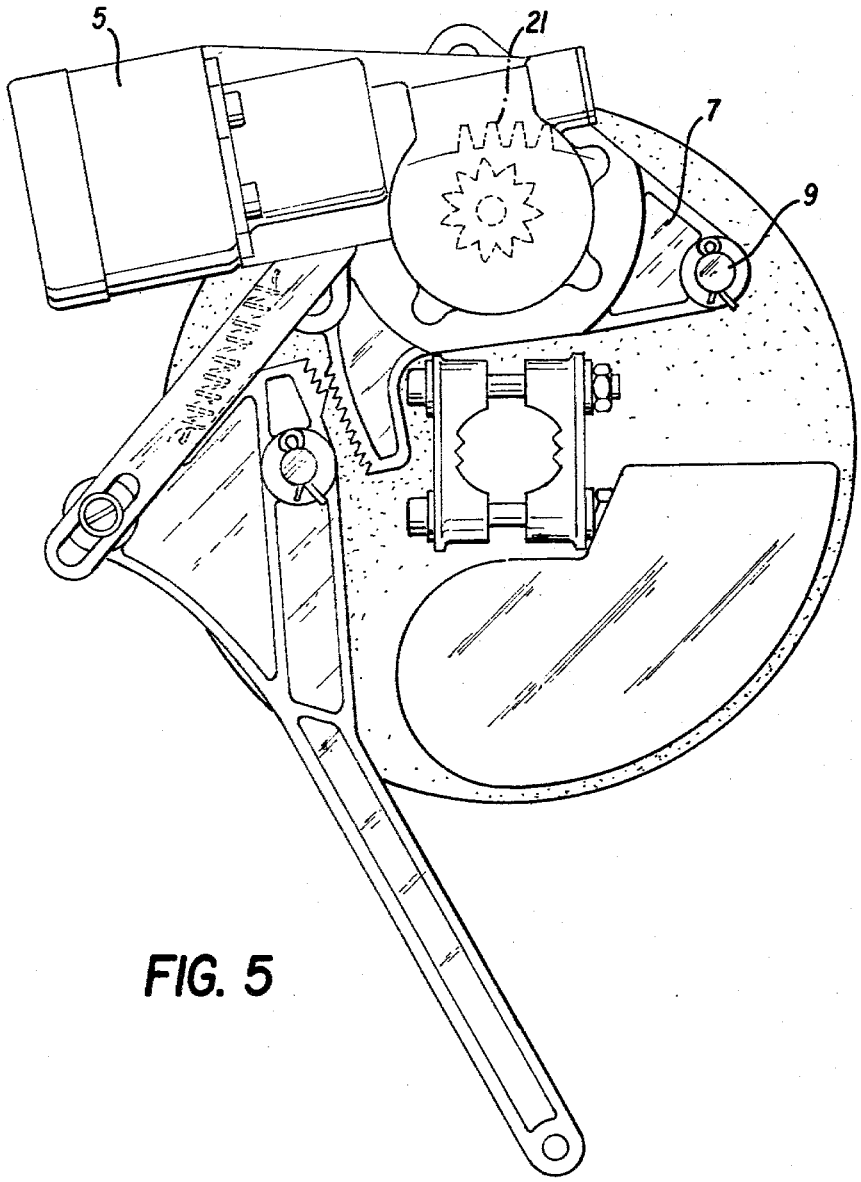
FIG. 5 is a view similar to FIG. 1 but with the pinion gear in the disengaged position.

The door curtain drum 20 (see FIGS. 3 and 4) is rotably mounted on the axle behind the plate 3 and has an internal ring gear 21 disposed adjacent the periphery of plate 3, all as in conventional doors.

A reversible electric motor 5, and a worm and wheel gear box 6 are secured each to each and to a pivotally mounted bracket 7. The output shaft of the box 6 extends through a slot in the plate 3 and carries a pinion 8 adapted to mesh with the drum ring gear 21.

The bracket 7 is secured to the plate 3 by means of pivot pin 9 projecting from the plate 3 through an eye in the bracket 7. The securement is maintained by means of a washer 11 and split pin 10.

Releasable latch means normally hold the bracket 7 in an operative position wherein the pinion 8 engages the ring gear 21.

Those latch means comprise an arcuate rack 12 on the bracket 7, a multi-toothed pivotally mounted pawl element 13 with teeth engageable with those of the rack and a handle lever 14 integral with the pawl element 13.

The arc of the line of teeth of the rack 12 is centered on the axis of pin 9 so that the pawl element may continue to engage the rack at all points on its travel as and when the bracket 7 pivots about that pin.

Figure 1:
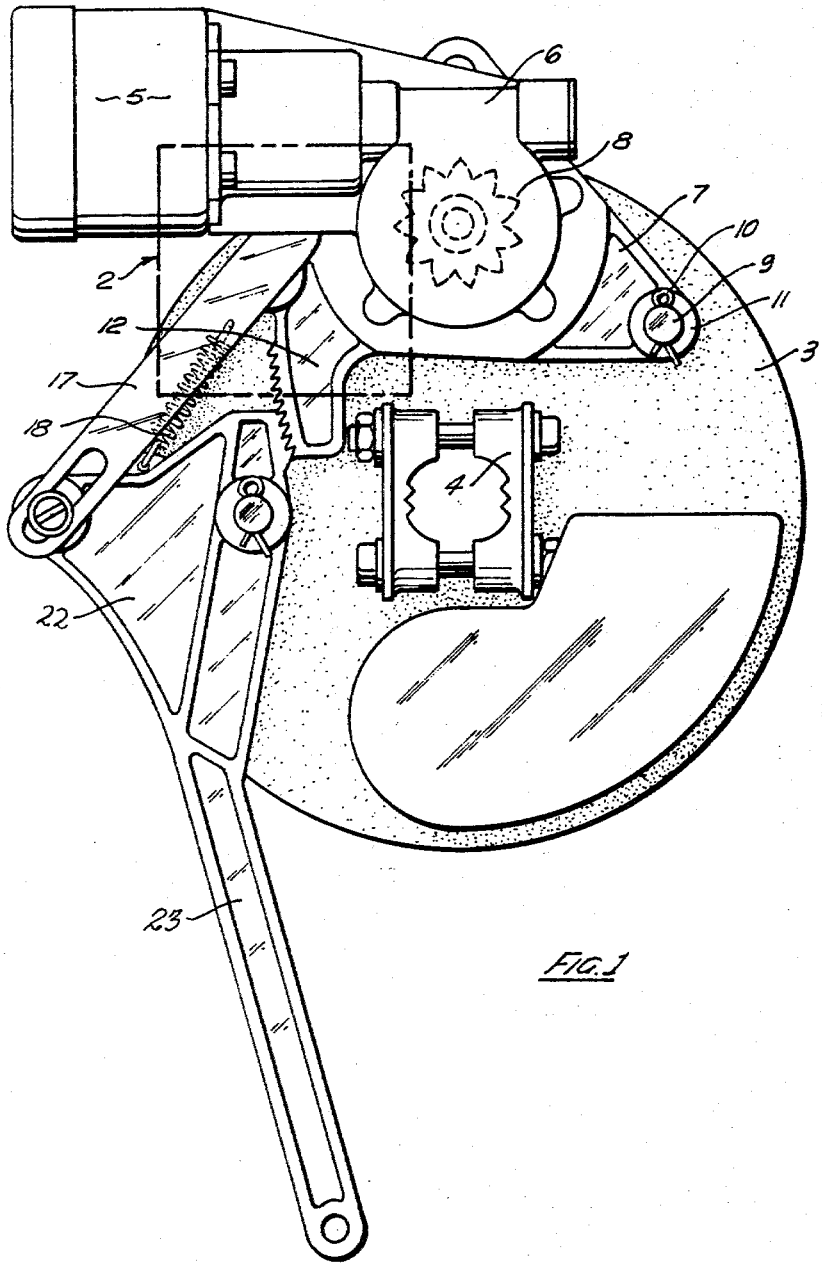
FIG. 1 is a front elevation of a roller door drum driving mechanism according to the invention showing the pinion gear in the engaged position.
Figure 2:
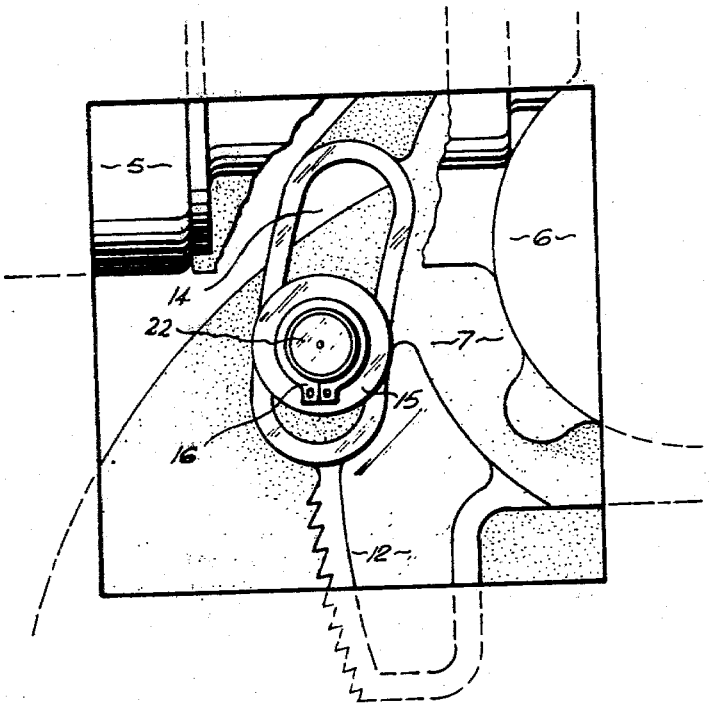
FIG. 2 is a detail view of the part of FIG. 1 within the enclosure marked 2 in that figure, drawn to a larger scale and with overlying parts cut away or removed to show underlying parts.

The extent to which the bracket 7 may pivot is limited by a buffer pin 22 (see FIG. 2) extending from the plate 3 through a slot 14 in the bracket. The pin 22 is furnished with a washer 15 and circlip 16 which serve to keep the bracket in parallel alignment with the plate 3.

In use, if the motor 5 should fail, a person may pull on the handle 23, either directly or by way of a cord (not shown) affixed to the free end thereof, to take the pawl element 13 away from the rack 12 so leaving the motor 5, box 6 and pinion 8 free to drop, so disengaging the pinion 8 from the drum ring gear 21.

In case the pinion is jammed into the ring gear, a pull-link 17 may be provided extending loosely from the pawl element 13 to the bracket 7.

An anti-rattle spring 18 serves to take up the slack in the connection between the link 17 and the bracket.

An advantage of the illustrated embodiment of the invention by comparison with the prior art is that in the event of looseness due to wear or otherwise between the pinion and ring gear, the bracket may be advanced by a rack tooth to compensate.

We claim:

1. A door drum driving mechanism comprising a pivotally mounted electric motor, a gear train fixedly associated with said motor terminating in a pinion, a ring gear on said drum and manually operable releasable latch means which secure said motor and train in an operative position wherein the pinion meshes with the ring gear but, when released permit the motor to move to an inoperative position wherein the pinion is clear of the ring gear.

2. A door drum driving mechanism as claimed in claim 1 wherein said manually operable release latch means comprise an arcuate rack and a multi tooth pawl element.

3. A door drum driving mechanism as claimed in claim 2 wherein said pawl element is operable by a handle lever.

4. A door drum driving mechanism as claimed in either claim 2 or claim 3 wherein the arcuate rack is centered on the axis of rotation of the pivotally mounted electric motor and gear train.

5. A door drum driving mechanism as claimed in claim 2 wherein a pull link operatively joins the pivotally mounted electric motor and gear train to the pawl element such that upon retraction of said pawl element the link bar pulls said electric motor and gear box into the inoperative position.

* * * * *